United States Patent [19]

Kirkman

[11] 4,420,205

[45] Dec. 13, 1983

[54] LOW INSERTION FORCE ELECTRONIC COMPONENT SOCKET

[75] Inventor: Michael Kirkman, Barrington, R.I.

[73] Assignee: Augat Inc., Mansfield, Mass.

[21] Appl. No.: 301,989

[22] Filed: Sep. 14, 1981

[51] Int. Cl.[3] ..... H01R 13/629

[52] U.S. Cl. ..... 339/74 R; 339/17 CF; 339/176 M

[58] Field of Search ..... 339/74 R, 75 M, 176 M, 339/17 CF

[56] References Cited

U.S. PATENT DOCUMENTS

| | | | |
|---|---|---|---|
| 3,763,459 | 10/1973 | Millis | 339/75 M |
| 4,083,619 | 4/1978 | McCormick et al. | 339/75 M |
| 4,331,371 | 5/1982 | Ichimura et al. | 339/74 R |
| 4,341,429 | 7/1982 | Bright et al. | 339/74 R |
| 4,343,524 | 8/1982 | Bright et al. | 339/75 M |

FOREIGN PATENT DOCUMENTS

| | | | |
|---|---|---|---|
| 530379 | 11/1976 | U.S.S.R. | 339/75 M |

*Primary Examiner*—John McQuade

*Attorney, Agent, or Firm*—Weingarten, Schurgin, Gagnebin & Hayes

[57] ABSTRACT

A socket for a multiple pin electronic component into which the component can be inserted and removed with subtantially no insertion or removal force. The socket comprises a base having an array of spring terminals and a plate slideable with respect to the base and operative to transpose the terminals along the plane of the socket. A camming element is associated with the plate and is movable between open and closed positions. In the open position of the terminals are urged to an open condition to permit easy insertion and removal of the pin terminals of an electronic component. In the closed position, the terminals are in biased engagement with the component pins to provide proper electrical contact.

10 Claims, 3 Drawing Figures

LOW INSERTION FORCE ELECTRONIC COMPONENT SOCKET

FIELD OF THE INVENTION

This invention relates to electronic component sockets and more particularly to a socket for multiple pin components in which the component can be easily inserted and removed.

BACKGROUND OF THE INVENTION

Electronic components are often retained in sockets mounted on a circuit board and in which pin terminals of the component are engaged by spring terminals of the socket with a force sufficient to maintain good electrical contact. In multiple pin electronic components, especially those having a large number of pin terminals such as microprocessor chips, the insertion force necessary to seat the component in an associated socket can be considerable and can lead to difficulty in installation of a component into its socket. The removal of the component from the socket also requires a force of magnitude sufficient to cause likely damage or even destruction of the component. Removal of a component from sockets of conventional construction often requires use of a tool for prying the component out of the socket.

SUMMARY OF THE INVENTION

Briefly, the present invention provides a socket into which a multiple pin electronic component can be inserted with substantially no insertion force, and after insertion, retained in the socket with sufficient force to provide good electrical contact. The novel socket also allows easy removal of the component from the socket with little force. The novel socket comprises a base having an array of spring terminals retained therein and arranged to correspond with the pin configuration of a component to be mated with the socket, and a plate retained for sliding movement on the base and through which the spring terminals pass and operative to transpose the terminals by a small amount along the plane of the socket. A camming element is associated with the socket plate and is movable between first and second positions. In the first position, the plate is urged to its open position in which the terminals are opened or unloaded to permit easy insertion and removal of the pin terminals of an electronic component. In the second position, the plate is in its closed position in which the terminals are in biased engagement with the pins to provide proper electrical contact. In preferred embodiment, the plate is normally in its closed position and is moved to its open position by depression of a camming plug having a conically shaped head which coacts with the plate to cause lateral movement of the plate. Upon raising of the plug, the plate returns to its closed position under the biasing force of the spring terminals.

DESCRIPTION OF THE DRAWINGS

The invention will be more fully understood from the following detailed description taken in conjunction with the accompanying drawing, in which.

DETAILED DESCRIPTION OF THE INVENTION

Figure 1:
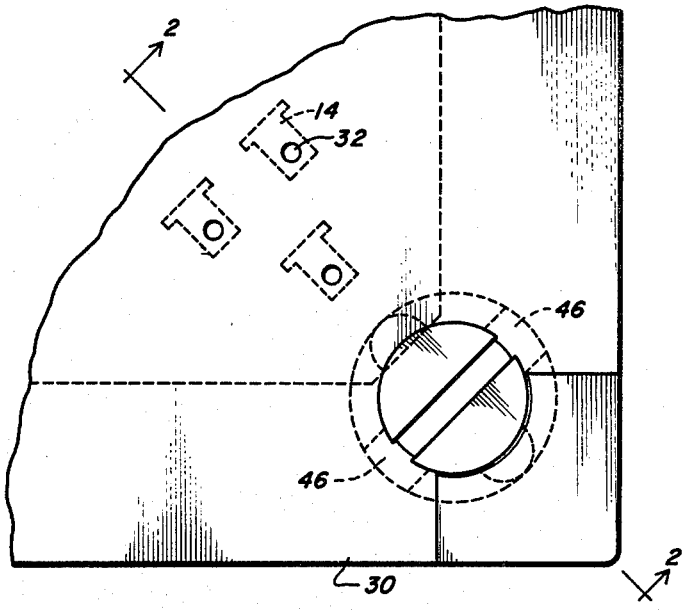
FIG. 1 is a cutaway top view of an electronic component socket in accordance with the invention.
Figure 3:
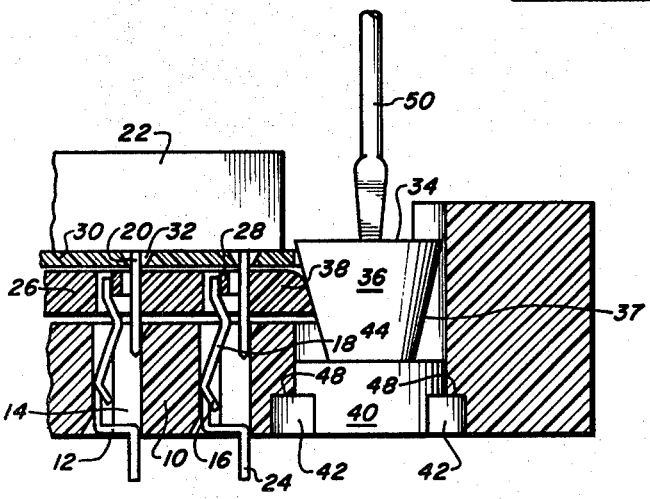
FIG. 3 is a sectional view taken along line 2—2 of FIG. 1 and illustrating the socket in its open position.
Figure 2:
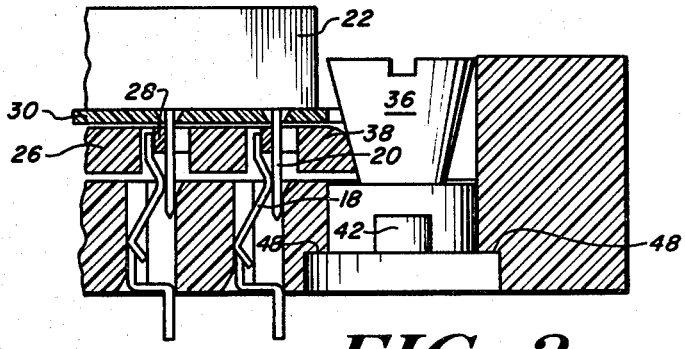
FIG. 2 is a sectional view taken along lines 2—2 of FIG. 1 and illustrating the socket in its normal or closed position.

The electronic component socket constructed and operative in accordance with the invention is illustrated in FIGS. 1–3 and includes a base 10 having an array of spring terminals 12 disposed therethrough in respective openings 14. The spring terminals 12 are retained in respective openings 14 via barbs 16 which engage confronting surfaces of the openings 14 to retain the spring terminals in position. The spring terminals, typically beryllium copper, each includes an upper contact portion 18 adapted for electrical contact engagement with respective terminal pins 20 of an electronic component 22, plugable into the socket. The spring terminals each also includes a pin or lead portion 24 which extends outwardly from the base 10 and to which electrical connection is made to the socket. A plate 26 is disposed over the base 10 and is slideable with respect thereto along the plane of the base. The plate 26 includes a plurality of openings into which the upper ends of spring terminals 12 respectively extend, and in each such opening there is disposed a member 28 which is engageable with the upper end of respective terminals 12. A cover plate 30 retains the slideable plate 26 and includes openings 32 in alignment to receive the pins 20 of a component inserted into the socket. The socket is made of a suitable electrically insulative material, typically a plastic such as polyester.

A camming plug 34 is disposed within an opening at the corner of the base 10 and is rotatable about its axis and movable longitudinally along its axis. The camming plug includes a head portion 36 having a conical peripheral surface 37 for mating with the confronting edge 38 of slideable plate 26. The head 34 of the camming plug is joined to a cylindrial portion 40 having radially extending key elements 42 which are disposed at diametrically opposite positions on the cylindrical portion 40. The base 18 includes a cylindrical bore 44 in which the cylindrical portion 40 of the camming plug is rotatable and axially movable. Key slots 46 are provided in communication with the cylindrical bore 44, and in which the keys 42 can be aligned to permit rising of the plug to its upper position as illustrated in FIG. 3.

The socket is illustrated in FIG. 2 in its normal position in which the plug 34 is in its raised position and wherein the spring terminals 12 have their contact portions 18 biased in electrical contact engagement with the respective pins 20 of electrical component 22. In this normal position, proper electrical contact is maintained between the component pins 20 and the spring terminals 12 of the socket. The bias action of the spring terminals maintains plate 26 in its normal position and maintains plug 34 in its raised position.

In the lower plug position illustrated in FIG. 3, the conical surface 37 of head 36 urges plate 26 laterally away from the plug (to the left in FIG. 3) and causes elements 28 to move the spring terminals out of their normal closed position. An electrical component 22 is easily plugged into the socket or removed therefrom in this open position, since the pins 20 fit loosely within the openings in the socket without any interference by the spring terminals which are maintained in their open or unloaded position by action of plate 26. The plug is manipulated by a screwdriver 50 or other suitable tool. In order to position the plug in its lower position, the keys 42 are aligned with the keyslots 46 by rotation of the plug, and in this aligned position the plug is depressed and rotated to seat the keys 42 under the shoulder 48 in the socket base, thereby to retain the plug in its lower position, as shown in FIG. 3. To return to the normal or raised plug position, the plug is rotated to align the keys 42 with respective keyslots 46, thereby to permit plate 26 to return to its normal position by the spring action of the spring terminals 12 and to cause raising of the plug by the force of edge 38 of plate 26 coacting against the conical surface 36 of the plug. The plug is captured in the socket base by the plate edge 38 interfering with the cylindrical plug portion 40.

The socket is typically of square or rectangular configuration to accommodate an associated multiple pin electrical component. In the illustrated embodiment, the socket base is approximately 1.7 inch square. The plate 26 moves laterally by a small amount, typically about 0.014 to 0.018 inch between open and closed positions. The axial travel of plug 34 is typically about 0.06 inch between open and closed positions.

In the illustrated embodiment, the plate 26 is movable along a diagonal axis. It is contemplated that the plate in other embodiments can be movable along a rectilinear axis of the socket package. It is also contemplated that the particular array of socket contacts can be configured in any manner to conform to the pin arrangement of an associated component to be mated with the socket. The invention is not therefore to be limited by what has been particularly shown and described except as indicated in the appended claims.

What is claimed is:

1. An electronic component socket comprising:

a base of electrically insulative material;

an array of spring terminals disposed in the base in a configuration corresponding to the terminal pin configuration of an electronic component to be mated with the socket;

a plate disposed for slideable movement on the base and having openings through which the spring terminal respectively pass;

a camming element moveable between first and second positions and cooperative with the plate;

the camming element being operative in its first position to urge the plate to an open position to cause lateral movement of the spring terminals such that the spring terminals will not engage the pins of an electrical component in the socket;

the camming element being operative in its second position to permit return of the plate to a closed position in which the spring terminals will be in electrical contact engagement with the pin of an electrical component in the socket; wherein the scanning element comprises a plug having a head with a conical surface cooperative with an edge of the plate to cause lateral movement thereof upon axial movement of the plug.

2. The electronic component socket of claim 1 wherein the camming element further includes key means cooperative with a keyway in the base to permit axial movement of the plug.

3. The electronic component socket of claim 1 wherein the camming element includes a plug having a cylindrical portion, a conical head portion and key elements outwardly extending from the cylindrical portion;

the plug being disposed in a keyed opening in the socket base and rotatable about its axis and movable along its axis;

the plug being axially movable to its first and second portions and rotatable to lock the plug in its first position and to align the key elements with the keyway to permit axial movement.

4. An electronic component socket comprising:

a base of electrically insulative material;

an array of spring terminals disposed in the base in a configuration corresponding to the terminal pin configuration of an electronic component to be mated with the socket;

a plate disposed for slideable movement on the base and having openings through which the spring terminals respectively pass;

a camming element moveable between first and second positions and cooperative with the plate;

the camming element being operative in its first position to urge the plate to an open position to cause lateral movement of the spring terminal such that the spring terminals will not engage the pins of an electrical component in the socket;

the camming element being operative in its second position to permit return of the plate to a closed position in which the spring terminals will be in electrical contact engagement with the pins of an electrical component in the socket; wherein the camming element comprises a plug having a head with a conical surface cooperative with an edge of the plate to cause lateral movement thereof upon axial movement of the plug; and the camming element having an upper surface and an engaging means on said upper surface for engaging a tool, thereby providing for rotational and axial movement of the camming element in response to rotational and axial movement of the tool.

5. The electronic component socket of claim 4 wherein the base has an upper surface which defines a first plane and the camming element has an upper surface defining a second plane is parallel to said first plane.

6. The electronic component socket of claim 5 wherein the camming element engaging means is accessible from the top surface of the element corresponding to the top surface of the base to permit a plurality of said electronic component sockets to be mounted in a side by side confronting arrangement.

7. An electronic component socket comprising:

a base of electrically insulative material;

an array of spring terminals disposed in the base in a configuration corresponding to the terminal pin configuration of an electronic component to be mated with the socket;

a plate disposed for slideable movement on the base and having openings through which the spring terminals respectively pass; and a camming element moveable between first and second positions and cooperative with the plate;

the camming element being operative in its first position to urge the plate to an open position to cause lateral movement of the spring terminal such that the spring terminal will not engage the pin of an electrical component in the socket;

the camming element being operative in its second position to permit return of the plate to a closed position in which the spring terminals will be in electrical contact engagement with the pins of an electrical component in the socket;

said camming element including a plug having a cylindrical portion, a conical head portion and key elements outwardly extending from the cylindrical portion;

the plug being disposed in a keyed opening in the socket base rotatable about its axis and moveable along its axis;

the plug being axially moveable to its first and second portion and rotatable to lock the plug in its first position and to align the key elements with the key way to permit axial movement.

8. The electronic component socket of claim 7 wherein the camming element has a top surface and the base has a portion with a top surface and the top surface of the camming element is coplanar with the top surface of said portion of the base.

9. The electronic component socket of claim 7 wherein the camming element has a top surface and an engaging means on said top surface for engaging a tool, thereby providing for rotational and axial movement of the camming element in response to rotational and axial movement of the tool.

10. The electronic component socket of claim 9 wherein the camming element engaging means is accessible from the top surface of the element which is parallel to the top surface of the base thereby allowing a plurality of said electronic component sockets to be mounted side-by-side or end-to-end in a confronting arrangement.

* * * * *